US005879478A

United States Patent [19]

Loue et al.

[11] Patent Number: 5,879,478

[45] **Date of Patent: *Mar. 9, 1999**

[54] PROCESS FOR SEMI-SOLID FORMING OF THIXOTROPIC ALUMINUM-SILICON-COPPER ALLOY

[75] Inventors: Willem Loue, Chirens; Michel Garat, St. Quentin-sur-Isere, both of France

[73] Assignee: Aluminium Pechiney, Courbevoie, France

[ * ] Notice: This patent issued on a continued prosecution application filed under 37 CFR 1.53(d), and is subject to the twenty year patent term provisions of 35 U.S.C. 154(a)(2).

[21] Appl. No.: 806,399

[22] Filed: Feb. 26, 1997

[30] Foreign Application Priority Data

Mar. 20, 1996 [FR] France ..... 96 03703

[51] Int. Cl.[6] ..... C22C 21/00

[52] U.S. Cl. ..... 148/438; 420/532; 420/531; 420/529; 420/528; 420/533; 420/534; 420/535; 420/537; 420/538; 148/437

[58] Field of Search ..... 148/437, 438; 420/532, 531, 529, 528, 533, 534, 535, 537, 538

[56] References Cited

U.S. PATENT DOCUMENTS

| | | | |
|---|---|---|---|
| 4,808,374 | 2/1989 | Awano et al. | 420/537 |
| 5,211,778 | 5/1993 | Sasaki et al. | 148/552 |
| 5,453,244 | 9/1995 | Tanaka et al. | 420/532 |

*Primary Examiner*—Robert Davis
*Assistant Examiner*—M. Alexandra Elve
*Attorney, Agent, or Firm*—Dennison, Meserole, Pollack & Scheiner

[57] ABSTRACT

The invention relates to an aluminum alloy for thixoforming with the composition (by weight): Si: 5%–7.2% Cu: 1%–5% Mg<1% Zn<3% Fe<1.5% other elements<1% each and<3% in total, with % Si<7.5–% Cu/3, which, when reheated to the semisolid state to the point at which a liquid fraction ratio between 35 and 55% is obtained, has an absence of non-remelted polyhedral silicon crystals.

7 Claims, 1 Drawing Sheet

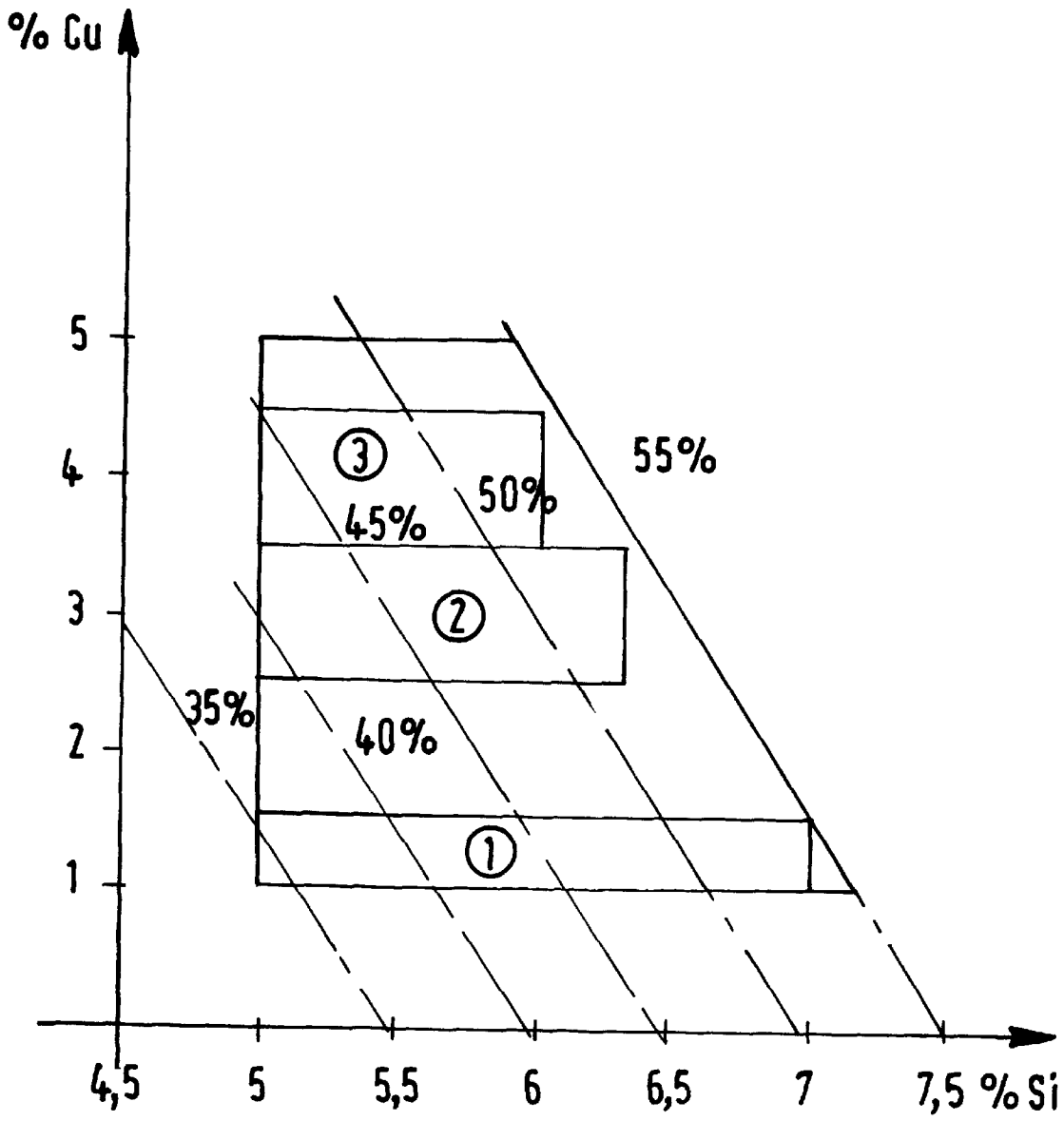
FIGURE UNIQUE

PROCESS FOR SEMI-SOLID FORMING OF THIXOTROPIC ALUMINUM-SILICON-COPPER ALLOY

FIELD OF THE INVENTION

The invention relates to the field of aluminum-silicon-copper alloys which may contain other alloying elements such as magnesium, cast into billets having a globular solidification structure which endows them with thixotropic properties and intended to be formed by forging or pressure injection, after being reheated to a semisolid state. Forming of this type is known as thixoforming.

DESCRIPTION OF RELATED ART

Thixoforming developed from the discovery made in the early 1970s by Prof. FLEMINGS' team at MIT that a metal melted under certain particular conditions, when reheated to a semisolid state, has an apparent viscosity which is highly dependent on the shear rate, so that it behaves like a solid during handling and like a viscous liquid when injected into a mold. This property, as compared to the traditional forming processes, results in a better metallurgical quality of the pieces produced, higher production rates, less wear on tools and molds and energy conservation.

To this end, the solidification of the metal during thixoforming must result in a globular, non-dendritic structure, which can be obtained either by mechanical agitation of the solid-liquid mixture as in the MIT patent U.S. Pat. No. 3,948,650, by electromagnetic agitating as in the ITT-ALUMAX patents U.S. Pat. No. 4,434,837 and U.S. Pat. No. 4,457,355 or the ALUMINIUM PECHINEY patents EP 0351327 and EP 0439981. The billets cast in this way are cut into blanks which correspond to the quantity of metal required to fabricate the piece to be formed, these blanks being reheated to the semisolid state, generally by induction heating, and transferred to the forming equipment (forging press or pressure injection machine). This process was developed industrially primarily for aluminum alloys intended for the fabrication of parts for the automobile industry. In fact, nearly all deliveries involve alloys of the Al—Si7Mg type with 7% silicon and less than 1% magnesium, for example the alloys Al—Si7Mg0.3 and Al—Si7Mg0.6 (A356 and 357 according to the Aluminum Association's nomenclature for casting alloys). These alloys have excellent suitability for thixoforming. In effect, when they are reheated so as to obtain a liquid fraction ratio on the order of 50%, which corresponds to the optimum rheological properties of the metal, the eutectic phase is completely remelted, whereas the melting of the primary silicon phase is not begun.

The mechanical properties of pieces produced using these alloys are good, and it is possible to adjust their strength and/or their ductility by using different heat treatments. However, the maximum tensile strength for an alloy of this type with 0.6% magnesium remains limited to about 350 MPa in the T6 state.

To improve the mechanical strength of alloys intended for thixoforming, either in order to increase the strength of the fabricated pieces or to facilitate machining, the use of alloys containing from 1 to 5% copper was tried. With an alloy with 3% copper, for example, no particular problem was encountered during the casting of the billets, and the mechanical strength at the level of the billet was effectively improved by more than 25%. If the temperature of the reheating to the semisolid state is adjusted by being lowered several degrees C, in order to retain a liquid fraction ratio near 50%, the thixoforming of this alloy is just as easy to carry out. On the other hand, a substantial reduction, by nearly half, is observed in the elongation of the treated T6 piece relative to that measured in the billet in the same metallurgic state, whereas for the copper-free alloy, the elongation of the treated billet and that of the treated piece are practically identical.

The Applicant attempted to determine the reason for this surprising behavior. A microstructural analysis of the copper alloy blanks reheated to the semisolid state, then quenched in water, revealed the presence of embrittling masses of silicon crystals in polyhedral form. These same masses were also in evidence on the surface of fracture of the tensile test pieces taken from pieces thixoformed from these blanks. One hypothesis which makes it possible to explain this microstructure is that the eutectic phase was not completely remelted, as in the case of copper-free Al—Si7Mg alloys, and that the silicon of the eutectic coalesced to form masses of coarse crystals.

In order to avoid these masses of silicon crystals which are detrimental to the elongation of the pieces, the inventors tried to increase the reheating temperature so as to obtain a complete remelting of the eutectic phase. But this resulted in a liquid fraction ratio on the order of 60%, causing a collapse of the reheated blank during handling, which made thixoforming no longer possible under acceptable industrial conditions.

SUMMARY OF THE INVENTION

The object of the invention is to find a range of composition for aluminum-silicon alloys with more than 5% silicon and containing from 1 to 5% copper, making it possible to solve the dilemma revealed above, that is, to allow both problem-free thixoforming and the obtaining of pieces having high mechanical strength and good elongation.

The subject of the invention is an aluminum alloy intended for thixoforming, with the composition (% by weight): Si: 5%–7.2% Cu: 1%–5% Mg<1% Zn<3% Fe<1.5% other elements<1% each and 3% in total, such that % Si<7.5–% Cu/3, which, when it is reheated to the semisolid state to the point at which a liquid fraction ratio between 35% and 55% is obtained, has a structure free from non-remelted polyhedral silicon crystals.

Within this range, it is possible to define three particular compositions such that:

| | | |
|---|---|---|
| 1) | Si: 5%–7% | Cu: 1%–1.5% |
| 2) | Si: 5%–6.3% | Cu: 2.5%–3.5% |
| 3) | Si: 5%–6% | Cu: 3.5%–4.5% |

BRIEF DESCRIPTION OF THE DRAWING

FIG. 1 shows, in a graph having as its abscissa the silicon content and as its ordinate the copper content, the lines of equal eutectic fraction and the range of composition according to the invention.

DESCRIPTION OF THE INVENTION

The alloys according to the invention remain within the normal ranges of composition for AlSiCu casting alloys. The silicon content does not go below 5% since at that point the alloy becomes difficult to cast. The addition of copper only begins to have a significant effect on mechanical strength and machinability at a content of about 1%, and above 5%, there is an extremely unfavorable effect on elongation. Magnesium, at a content lower than 1%, increases the response to heat treatment due to the formation of hardening $Mg_2Si$ particles, but above 1%, it too has an unfavorable effect on elongation.

Relatively high zinc and iron contents can be observed in the case in which the process starts with secondary metal derived from recycling. These contents are obviously much lower when starting from primary metal.

It is also possible to add, as is usually done in AlSi casting alloys, an agent for modifying the silicon of the eutectic, such as sodium, strontium or antimony, which prevents the formation of overly coarse grains of silicon. Sodium and strontium can be present alone or together, but antimony is always alone. The strontium content, for example, is between 0.005 and 0.05%. Likewise, an addition of up to 0.2% titanium and/or up to 0.1% boron produces a refining of the grain and better heat resistance.

For copper alloys, in order to maintain the same rheological properties during thixoforming as for alloys of identical composition but free from copper, while also obtaining a complete remelting of the eutectic silicon in the blank reheated to the semisolid state, and guaranteeing good elongation in the finished piece, the inventors had the idea to modify the silicon content as a function of the copper content. Thus, it was discovered that it was possible to obtain a behavior during thixoforming identical to that of an Al—Si7 alloy for an Al—SiCu alloy if the Si and Cu contents of this alloy conformed to the relation:

$$\% \text{ Si}=7-\% \text{ Cu}/3. \quad (1)$$

The line which represents this relation in the figure is the line of the compositions which correspond to 50% eutectic fraction. Thus, an alloy Al—Si6Cu3Mg0.6 or an alloy Al—Si6.5Cu1.5Mg0.6 has a behavior during thixoforming identical to that of an alloy Al—Si7Mg0.6, which means that it is possible, upon reheating, to obtain a liquid fraction ratio near 50% with a complete melting of the eutectic, and thus an absence of polyhedral silicon crystals.

For both compositions mentioned, it was verified that the metal loss was 8±2%, identical to that of the alloy Al—Si7Mg0.6. The apparent viscosity of the blanks, reheated to a temperature between 2° and 5° C. above the eutectic point, was measured by means of a penetration test which consisted of measuring the yield strength F of the reheated blank, compressed by a tool at a constant speed at the end of a stroke of predetermined length. The ratio of this force F to a constant force threshold $F_s$ was established for a conventional value of metal loss by exudation of 8%, metal loss being an indicator of the liquid fraction ratio for a given material.

For both compositions mentioned, an F/Fs ratio on the order of 0.45 was found, which is similar to that measured in a blank of the alloy Al—Si7Mg0.6.

Since the liquid fraction ratio is controllable within approximately±5%, taking into account the normal ranges of silicon content allowed by the standards and specifications for the alloys in question, it is possible to estimate that in the FIGURE, the composition of the alloy must be such that the Si and Cu contents conform to the relation $$6.5-\% \text{ Cu}/3<\% \text{ Si}<7.5-\% \text{ Cu}/3 \quad (2)$$

which corresponds to the fact that the liquid fraction ratio obtained with complete melting of the eutectic is between 45 and 55%, or that the eutectic fraction of the alloy is between 45 and 55%.

Furthermore, it was determined that it was possible, for alloys containing copper, to obtain good behavior during thixoforming by reheating the blanks until a liquid fraction ratio sharply lower than 50% was obtained. Thus, for an alloy with 5% Si and 3% Cu, it is possible to go down to a 40% liquid fraction, and for an alloy with 5% Si and 1.5% Cu, to about 35%. On the other hand, when testing an alloy with 4% silicon and 3% copper, it was determined that because of its wide solidification range (625°–560° C.), the casting of thixotropic billets was difficult to carry out, resulting in casting defects such as dislocations and voids. Moreover, its behavior during thixoforming is unsatisfactory: as soon as the filling of the mold cavity begins, the heat loss through exchange with the wall of the mold causes a partial re-solidification and an increase in the apparent viscosity, which results in defects in the injected piece, such as laps, shrink cavities or recesses.

Thus, in reference to FIG. 1 representing the silicon and copper contents, in which the lines of equal eutectic fraction appear, it is noted that the range which corresponds to the compositions according to the invention comprises not only the band between the lines representing the eutectic fractions of 55% and 45%, that is, the fringe surrounding the line representing 50%, but also the area between 45% and 35% which, taking into account the lower limit of Cu at 1%, virtually corresponds to the adjacent triangle.

What is claimed is:

1. A process for forming an aluminum alloy part, comprising the steps of:

a) providing an alloy consisting essentially of, in weight %:

| | |
|---|---|
| Si | 5–7.2 |
| Cu | 1–5 |
| Mg | <1 |
| Zn | <3 |
| Fe | <1.5 |
| other | <1 each and <3 total |
| Al | remainder, |
| with % Si < 7.5 − % Cu/3; | |

b) bringing the alloy to a semi-solid state with a liquid fraction ratio between 35 and 55%, and a globular, non-dendritic structure free from remelted polyhedral silicon crystals; and c) forming the part from the alloy in the semi-solid state by forging or pressure injection.

2. The process according to claim 1, wherein Si is between 5 to 7% and Cu is between 1 and 1.5%.

3. The process according to claim 1, wherein Si is between 5 and 6.3% and Cu is between 2.5 and 3.5%.

4. The process according to claim 1, wherein Si is between 5 and 6% and Cu is between 3.5 and 4.5%.

5. The process according to claim 1, wherein the alloy additionally contains 0.005 to 0.05% strontium.

6. The process according to claim 1, wherein the alloy additionally contains up to 0.2% titanium.

7. The process according to claim 1, wherein the alloy additionally contains up to 0.1% boron.

* * * * *

UNITED STATES PATENT AND TRADEMARK OFFICE

CERTIFICATE OF CORRECTION

PATENT NO. : 5,879,478

DATED : March 9, 1999

INVENTOR(S) : WILLEM LOUE et al

It is certified that error appears in the above-indentified patent and that said Letters Patent is hereby corrected as shown below:

In the Claims:

Claim 1, column 4, line 48, change "remelted"

to --non-remelted--.

Signed and Sealed this

Tenth Day of August, 1999

*Attest:*

Q. TODD DICKINSON

*Attesting Officer*

*Acting Commissioner of Patents and Trademarks*